US006698746B2

(12) United States Patent
Buck et al.

(10) Patent No.: US 6,698,746 B2
(45) Date of Patent: Mar. 2, 2004

(54) CROSSCUTTER

(75) Inventors: Hermann Karl Buck, Dettingen (DE); Holger Edinger, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/855,930

(22) Filed: May 15, 2001

(65) Prior Publication Data

US 2001/0040339 A1 Nov. 15, 2001

(30) Foreign Application Priority Data

May 15, 2000 (DE) ..... 100 23 558

(51) Int. Cl.[7] ..... B65H 5/02
(52) U.S. Cl. ..... 271/9.04; 271/272; 83/86
(58) Field of Search ..... 271/3.01, 3.11, 271/3.08, 9.01, 91, 9.04, 272, 269; 83/94, 92, 91, 90, 89, 86

(56) References Cited

U.S. PATENT DOCUMENTS 2,635,874 A * 4/1953 Bore ..... 271/35
3,219,339 A * 11/1965 Gutierrez ..... 271/11
3,481,598 A * 12/1969 Lopez ..... 271/184
3,507,489 A * 4/1970 Wilshin et al. ..... 271/182
3,960,373 A * 6/1976 Pacholok ..... 271/10
3,997,155 A * 12/1976 Martin ..... 271/272
4,163,550 A * 8/1979 Armstrong ..... 271/274
4,214,744 A * 7/1980 Evans ..... 271/202
4,966,521 A * 10/1990 Frye et al. ..... 414/788.8
5,464,203 A * 11/1995 Bowser et al. ..... 271/12
5,626,338 A * 5/1997 Fattebert ..... 271/274
5,913,656 A * 6/1999 Collins ..... 414/801

FOREIGN PATENT DOCUMENTS

DE 7601552 5/1976
DE 2922959 1/1980
DE 4122947 A1 1/1993

* cited by examiner

*Primary Examiner*—Donald P. Walsh
*Assistant Examiner*—Joseph C Rodriguez
(74) *Attorney, Agent, or Firm*—Laurence A. Greenberg; Werner H. Stemer; Gregory L. Mayback

(57) ABSTRACT

A device for transporting sheets in a region of a selectively usable sheet pile feeder includes a crosscutter of a sheet-fed processing machine having conveyor belts and contact-pressure devices cooperating therewith for feeding the sheets from the crosscutter, and a separating device of the sheet pile feeder, whereon contact-pressure devices are disposed.

23 Claims, 3 Drawing Sheets

CROSSCUTTER

BACKGROUND OF THE INVENTION

FIELD OF THE INVENTION

The invention relates to a device for transporting sheets from a crosscutter to a sheet-fed processing machine, in particular a printing press. A paper supply roll is provided for the crosscutter, from which a web of paper is drawn and supplied to the crosscutter. The crosscutter, which cuts the web of paper into the sheets to be processed, if necessary or desirable, has a device for forming a shingled or overlapping stream of sheets, which is supplied to the sheet-fed processing machine.

Such a device has become known heretofore from the German Utility Model (DE-GM) 7601552, for example. In addition to the crosscutter, the device shown therein has a sheet pile feeder, which is selectively activatable. If the sheet-fed processing machine is supplied from the paper roll feeder and the crosscutter, then the suction head of the sheet pile feeder, which is provided for handling the sheet pile, remains out of operation.

SUMMARY OF THE INVENTION

It is an object of the invention to provided a device for transporting sheets from a crosscutter to a sheet-fed processing machine, which guides the single sheets produced by the crosscutter, or the shingled or underlapping sheet stream made up of a succession of sheets one under the other, in the region of the suction head of the sheet pile feeder.

With the foregoing and other objects in view, there is provided, in accordance with the invention, a device for transporting sheets in a region of a selectively usable sheet pile feeder, comprising a crosscutter of a sheet-fed processing machine having conveyor belts and contact-pressure devices cooperating therewith for feeding the sheets from the crosscutter, and a separating device of the sheet pile feeder, whereon contact-pressure devices are disposed.

In accordance with another feature of the invention, the contact-pressure devices disposed on the separating device of the sheet pile feeder are remotely adjustable in one direction selected from the group thereof consisting of in the direction of the sheet transport and counter thereto, respectively, by the separating device.

In accordance with a further feature of the invention, the contact-pressure devices disposed on the separating device of the sheet pile feeder is adjustable in height by the separating device.

In accordance with an added feature of the invention, the sheet-transporting device includes a motor-drivable threaded spindle and a linear guide.

In accordance with an additional feature of the invention, the sheet-transporting device includes a further motor-drivable threaded spindle.

In accordance with yet another feature of the invention, the sheet-transporting device includes drive motors for remote adjustment connected to a control computer of the sheet-fed processing machine.

In accordance with yet a further feature of the invention, the contact-pressure devices, respectively, disposed on the separating device of the sheet pile feeder are embodied as rotatably supported brush rollers.

In accordance with yet an added feature of the invention, the brush rollers, respectively, are supported on the end of a leaf spring, and the leaf springs are disposed, displaceable transversely to the sheet transport direction, on a cross member.

In accordance with yet an additional feature of the invention, the cross member is secured to the separating device.

In accordance with a concomitant feature of the invention, the separating device is a suction head of the sheet pile feeder of a sheet-fed rotary printing press.

Advantageously, in the working region of the suction head, contact-pressure rollers are provided, which cooperate with conveyor belts of the crosscutter and thus assure accurate transport of the sheets in cadencing rollers which are provided. The contact-pressure rollers are secured to the suction head and can therefore be adjusted via the adjusting devices of the suction head. The suction head has a device that makes it possible to adjust for different paper sizes or formats. By this provision, the suction head, for example, assuming a preadjustment of the sheet-fed processing machine to the sheet size or format to be processed, can be preadjusted automatically via a control computer of the sheet-fed processing machine. By the disposition of the contact-pressure rollers on the suction head, in accordance with the invention, the adjusting device of the suction head serves for automatically adjusting the contact-pressure rollers.

Other features which are considered as characteristic for the invention are set forth in the appended claims.

Although the invention is illustrated and described herein as embodied in a crosscutter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
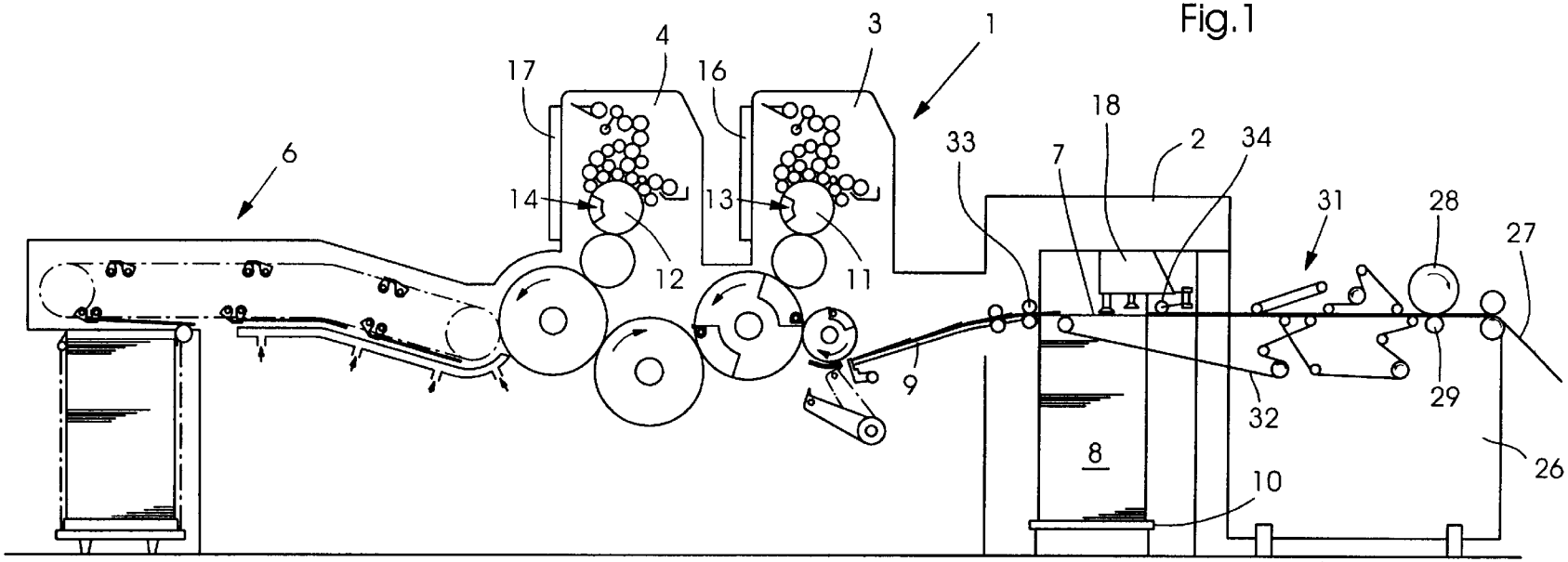
FIG. 1, a diagrammatic side elevational view of a sheet-fed processing machine, such as a printing machine, with a sheet pile feeder and a roller feeder.
Figure 2:
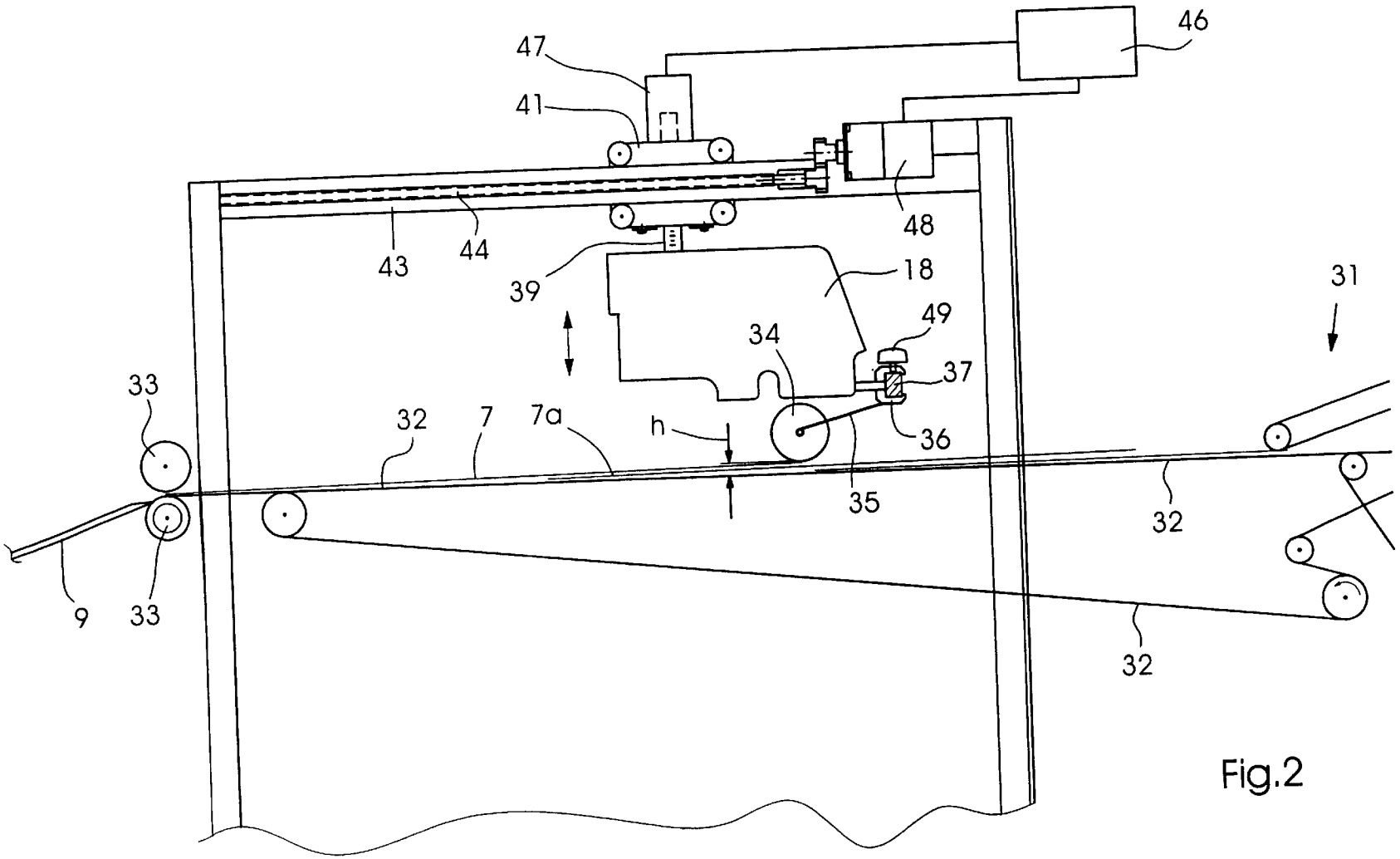
FIG. 2 an enlarged fragmentary view of FIG. 1, further showing schematically and diagrammatically, a conveyor or feed path in the region of the sheet pile feeder.

Referring now to the drawings and, first, particularly to FIG. 1 thereof, there is shown therein a rotary printing press, for example, a printing press 1 for processing sheets 7, having a feeder 2, at least one printing unit 3 and 4, respectively, and a delivery 6. The sheets 7 are taken from a sheet pile 8 and fed, then are either separated or singled into individual sheets or in a shingled or underlapping stream, to the printing units 3 and 4 via a feeding tray or table 9. Each of the printing units 3; 4, in a known manner, includes a plate cylinder 11; 12. The plate cylinders 11 and 12, respectively, have a device 13, 14 whereon flexible printing plates are fastened. Each plate cylinder 11; 12, respectively, has also assigned thereto a respective device 16; 17 for changing printing plates semi-automatically or fully automatically.

The sheet pile 8 rests on a pile or stacking tray 10 that can be raised in a controlled conventional manner. The sheets 7 are taken from the top of the sheet pile 8 by a so-called suction head 18 which, among other elements, has a number of lifting suction cups or suckers and pull or forwarding suction cups or suckers 19 and 21 for singling or separating the sheets 7. Moreover, non-illustrated blast or blower devices for loosening the upper sheet feeders and key elements for readjusting the sheet pile are also provided. For aligning the pile 8, and especially the upper sheets 7 of the pile 8, a number of lateral and rear stops are provided.

To enable the sheet-fed processing machine 1 to be supplied selectively with rolls of paper instead, a non-illustrated roller feeder is located upline of the sheet pile feeder 2. The roller feeder, among other elements, has a non-illustrated roll of paper and a crosscutter 26, which cuts a web of paper 27 into individual sheets 9 transversely to the transport direction, by a knife cylinder 28 and a counter-cutting cylinder 29 cooperating therewith. The crosscutter device 28, 29 is followed by a device for forming a succession of underlapping sheets, i.e., sheets lying shingled under one another. From the single sheets furnished by the crosscutter, this thus produces a stream of staggered underlapping imbricated sheets. A number of conveyor belts 32 located Side-by-side transport the imbricated stream in the region of the feeder to feeder rollers 33 at the beginning of the feeding tray or table 9.

To establish good contact of the imbricated stream of sheets with the conveyor belts 32, a number of contact-pressure rollers 34 are provided, which are secured to the suction head 18 of the sheet pile feeder 2. The contact-pressure rollers 34 are embodied as rotatably supported brush rollers, respectively, secured by a leaf spring 35 to respective mounts or holders 36, which are supported, so as to be displaceable crosswise, on a cross member 37 extending transversely to the sheet transport direction. The cross member 37 is secured on the suction head 18. The suction head 18 is disposed, adjustable in elevation, by a vertically disposed, motor-adjustable threaded spindle 39. The threaded spindle 39 is supported on a trolley 41. The trolley 41 is guided by two rails 42 and 43 and is adjustable in and counter to the sheet transport direction by a motor-driven threaded spindle 44. The drive motors 47 and 48, respectively, of the threaded spindles 39 and 44 are connected for control purposes to a control computer 46 of the sheet-fed processing machine 1.

Figure 3:
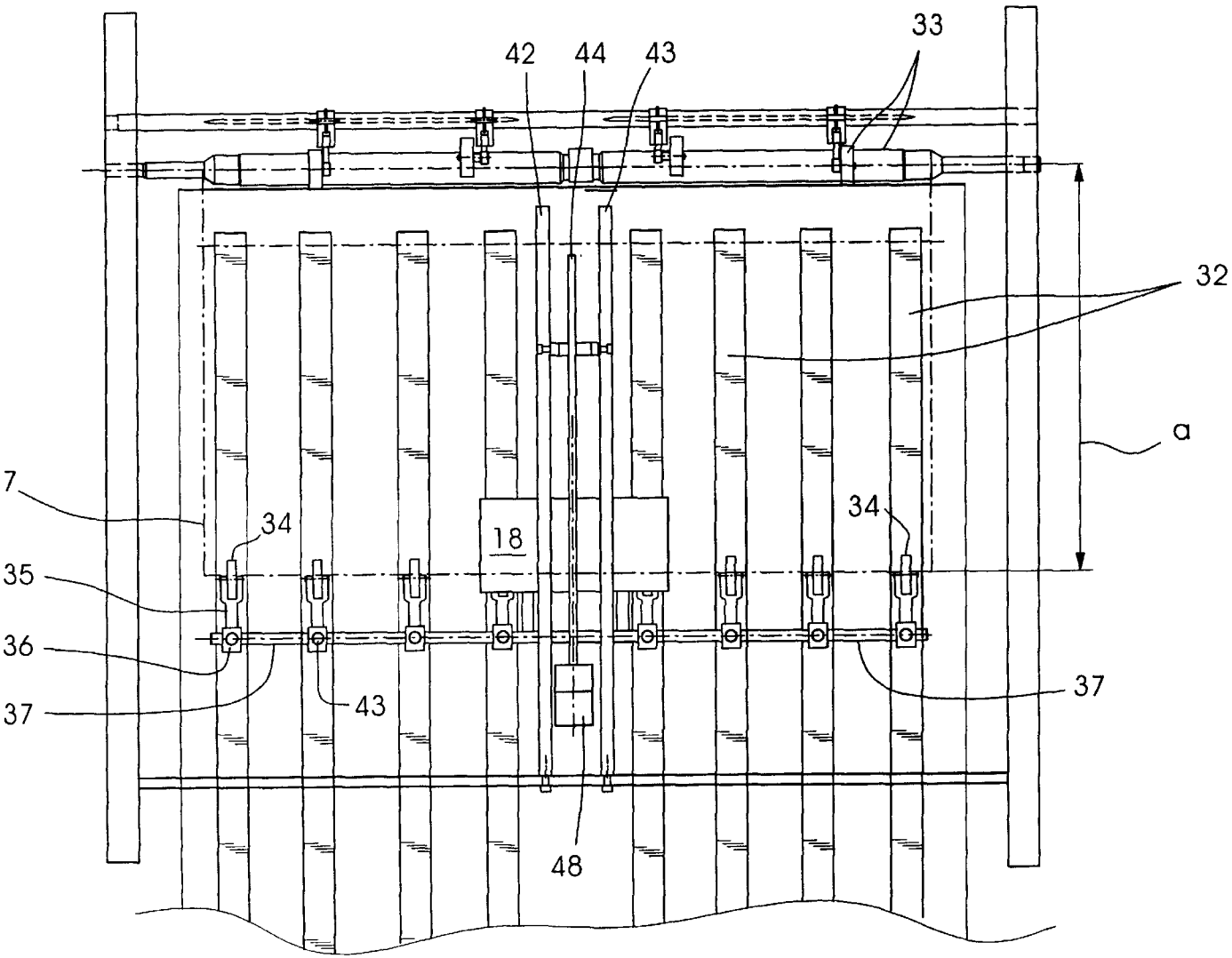
FIG. 3 is a top plan view of FIG. 2.

When roll paper is being processed, it is necessary for the stream of imbricated sheets, underlapping one another, which are transported in the feeder region, to be pressed against the conveyor belts 32 by the contact-pressure rollers 34, so that there will be no slip between the conveyor belts 32 and the underlapping imbricated sheet stream. As seen in FIG. 3, spacing a of the contact-pressure rollers 34 relative to the feeder rollers 33 is dimensioned so that the frontmost sheet, upon reaching the feeder rollers 33, has left the contact-pressure region of the contact-pressure rollers 34. When different format lengths are being processed, the spacing a is adjusted by displacement of the suction head 18 by the threaded spindle 44 in or counter to the sheet transport direction. An elevation or height adjustment of all the contact-pressure rollers 34 disposed on the cross member 37 is performed by the threaded spindle 39. An adjustment of the contact-pressure rollers 34 transversely to the sheet transport direction is performed by fastening screws 49 assigned to each mount 36.

An adjustment of the height h of the contact-pressure rollers 34 relative to the conveyor belts 32 and of the spacing a of the contact-pressure rollers 34 relative to the feeder rollers 33 can be effected by remote adjustment, automatically, via the control computer 46 as a function of the sheet size or format and sheet thickness.

We claim:

1. In a sheet-transporting device for transporting sheets at a sheet pile feeder, the sheets arriving from a crosscutter of a sheet-fed processing machine on a conveyor belt, the improvement comprising:

a separating device having adjustable contact-pressure devices contacting the sheets, said contact-pressure devices being automatically remotely adjusted to cooperate with the conveyor belt to prevent slippage between the conveyor belt and the sheets.

2. The sheet-transporting device according to claim 1, wherein said contact-pressure devices disposed on said separating device of the sheet pile feeder are remotely adjustable in one direction selected from the group thereof consisting of in the direction of a sheet transport and counter-direction thereto, respectively, by said separating device.

3. The sheet-transporting device according to claim 1, wherein said contact-pressure devices disposed on said separating device of the sheet pile feeder are adjustable in height by said separating device.

4. The sheet-transporting device according to claim 2, including a motor-drivable threaded spindle and a linear guide.

5. The sheet-transporting device according to claim 2, including a motor-drivable threaded spindle.

6. The sheet-transporting device according to claim 4, including drive motors for remote adjustment connected to a control computer of the sheet pile feeder.

7. The sheet-transporting device according to claim 1, wherein said contact-pressure devices disposed on said separating device of the sheet pile feeder are, respectively, embodied as rotatably supported brush rollers.

8. The sheet-transporting device according to claim 7, wherein said brush rollers, respectively, are supported on the end of a leaf spring, and said leaf springs are disposed, displaceable transversely to the sheet transport direction, on a cross member.

9. The sheet-transporting device according to claim 8, wherein said cross member is secured to said separating device.

10. The sheet-transporting device according to claim 9, wherein said separating device is a suction head of the sheet pile feeder of a sheet-fed rotary printing press.

11. A sheet-transporting device for transporting sheets, comprising:

a conveyor belt transporting the sheets;

a separating device for singling and separating the sheets from a sheet pile and transferring the sheets to said conveyor belt for transport, said separating device having adjustable contact-pressure devices contacting the sheets, said contact-pressure devices being automatically remotely adjusted to cooperate with said conveyor belt to prevent slippage between said conveyor belt and the sheets.

12. The sheet-transporting device according to claim 11, wherein said contact-pressure devices are remotely adjustable in a direction of the sheet transport or in a counter-direction thereto.

13. The sheet-transporting device according to claim 11, wherein said contact-pressure devices are adjustable in height.

14. The sheet-transporting device according to claim 12, further comprising a motor-drivable threaded spindle and a linear guide.

15. The sheet-transporting device according to claim 11, further comprising a feeder roller being disposed with a spacing from said contact-pressure devices along a direction of the sheet transport, the spacing being equal to a length of one of the sheets transported in the direction of the sheet transport.

16. The sheet-transporting device according to claim 14, including drive motors for remote adjustment connected to a control computer of a sheet-fed processing machine.

17. The sheet-transporting device according to claim 11, wherein said contact-pressure devices are embodied as rotatably supported brush rollers.

18. The sheet-transporting device according to claim 17, wherein said brush rollers are supported on the end of a leaf spring, and said leaf springs are disposed, displaceable transversely to the sheet transport direction, on a cross member.

19. The sheet-transporting device according to claim 18, wherein said cross member is secured to said separating device.

20. The sheet-transporting device according to claim 11, wherein said separating device is a suction head of a sheet pile feeder.

21. The sheet-transporting device according to claim 1, further comprising a computer for automatically remotely adjusting said contact-pressure devices.

22. The sheet-transporting device according to claim 21, wherein said computer is a control computer of a sheet-fed processing machine.

23. The sheet-transporting device according to claim 11, further comprising a computer for automatically remotely adjusting said contact-pressure devices.

* * * * *